US005366432A

United States Patent [19]

Habing et al.

[11] Patent Number: 5,366,432

[45] Date of Patent: Nov. 22, 1994

[54] LEG PRESS

[75] Inventors: Theodore G. Habing, Long Beach; Ron Gibson, Valencia, both of Calif.

[73] Assignee: Pacific Fitness Corporation, Cypress, Calif.

[21] Appl. No.: 900,602

[22] Filed: Jun. 18, 1992

[51] Int. Cl.[5] ..... A63B 21/06

[52] U.S. Cl. ..... 482/138; 482/100

[58] Field of Search ..... 482/99-103, 482/133-138, 909

[56] References Cited

U.S. PATENT DOCUMENTS

| | | | |
|---|---|---|---|
| 4,149,714 | 4/1979 | Lambert, Jr. | 482/100 |
| 4,349,192 | 9/1982 | Lambert, Jr. et al. | 482/101 |
| 4,511,137 | 4/1985 | Jones | 482/100 |
| 4,546,970 | 10/1985 | Mahnke | 482/138 X |
| 4,753,126 | 6/1988 | Sammaratano | 482/137 X |
| 4,763,897 | 8/1988 | Yakata | 482/100 |
| 4,842,271 | 6/1989 | Vinciguerra | 482/100 |
| 4,878,663 | 11/1989 | Luquette | 482/100 |
| 4,886,073 | 12/1989 | Dillon et al. | 482/909 X |
| 5,106,081 | 4/1992 | Webb . | |
| 5,135,457 | 8/1992 | Caruso | 482/100 X |

FOREIGN PATENT DOCUMENTS

| | | | |
|---|---|---|---|
| 3445104 | 6/1986 | Germany | 482/100 |

OTHER PUBLICATIONS

Paramount Fitness Equipment Corporation, "FTX", 1991.
Hoist, "Super Trainer—Deluxe Multi-Function Gym".
Hoist, "4000 E and Leg Press".
Pacific Fitness, "Catalina Series 3, 4 and 4+", 1990.
Keiser Sports Health Equipment, 1985.
Paramount, "Leg Press", p. 19.
Paramount, "Leg Press Uni-Flex Model SST-3", and Leg Press Standard Model SST-B, p. 13.
Polaris, "Hips/Legs".
Body Master, MD 117 Leg Press.
Badger, M3 Leg Press.
Flex, FL-107 Thighsolator Leg Press.
David 210, Leg Press.
Hammer Strength, Leg Press.
Hoggan, Power Leg Press.
Icarian, Leg Sled (Linear).
Muscle Dynamics, Leg Press 2066.
Pyramid, Leg Press.
Titan.
Universal, DVR Leg Press.
Cybex, Leg Press.
Lido Loridan.

*Primary Examiner*—Stephen R. Crow
*Assistant Examiner*—John Mulcahy
*Attorney, Agent, or Firm*—Blakely, Sokoloff, Taylor & Zafman

[57] ABSTRACT

A leg press machine that provides an increasing resistance curve which approximates the strength curve of a user. The machine has a weight stack that can move relative to a frame. The machine also has a push plate that is coupled to the weight stack by a cable which is guided and held in tension by a series of pulleys. The push plate is attached to a first linkage arm which is pivotally connected to a second linkage arm and a third linkage arm. The second and third linkage arms are pivotally connected to the frame, so that the push plate can rotate between a rest position and an extended position. Attached to the third linkage arm is a first rotating pulley that moves through an arc when the push plate moves between the rest and extended positions. The cable is coupled to the first rotating pulley, so that when the push plate moves toward the extended position, the arcuate motion of the pulley pulls the cable and lifts the weight stack. The linkage arms and pulley are assembled so that each successive displacement of the push plate and pulley, produces an incremental movement of the weight stack that is greater in length than the preceding incremental movement of the weight stack.

11 Claims, 5 Drawing Sheets

LEG PRESS

BACKGROUND OF THE INVENTION

1. Field of the Invention

The present invention relates to exercise machines, in particular a leg press typically used to strengthen the legs of a user.

2. Description of Related Art

Exercise machines have become a popular device for strengthening a user's muscles. One such type of machine is a leg press. A typical leg press will have a push plate that can move relative to a frame. The user will sit in a seat and push the plate with his legs, so that the plate moves from a rest position to an extended position. The push plate is coupled to some type of force resistance means, which provides a reactive force to the pushing motion of the user. The force resistance means is typically a weight stack that is lifted when the plate is moved toward the extended position. The weight stack is usually connected to the plate by a cable/pulley assembly. Movement of the push plate will pull a cable and lift the weight stack. The pulleys guide the cable and insure cable tension between the plate and weights.

When operating a leg press, the user typically begins the exercise routine with his legs bent, wherein movement of the push plate results in the straightening of the legs. Generally speaking, as the legs straighten, the leg muscles attain a leveraged advantage such that the strength of the user increases as the legs are extended to a straightened position. Consequently, when the user of a leg press machine pushes the push plate forward, the legs are able to apply a greater force as the legs move toward an extended position. To counteract this increase in leg strength it is desirable to provide a resistive force that matches the strength curve of the user. Present leg press machines with cable/pulley assemblies have provided either a linear resistance curve, or a resistance curve that both increases and decreases as the push plate is pushed forward. It would therefore be desirable to provide a cable/pulley leg press machine that provides a nonlinear increasing resistance curve that approximates the strength curve of a user.

Cable/pulley leg press machines typically incorporate a pair of linkage arms that are coupled to the push place. When the user pushes the plate forward, the plate is deflected through an angle as the linkage arms move through an arc. The plate deflection can induce an incorrect bio-mechanical movement of the user's feet, thereby causing undesirable stress in the ankle joints. It would therefore be desirable to have a leg press machine that provides bio-mechanically correct movement of the push plate.

Exercise machines are typically constructed from rugged metal components to support the user and weight stack of the system. When the user allows the push plate of a leg press to move from the extended position to the rest position, the linkage arms of the cable/pulley assembly tend to abruptly strike the frame. The sudden impact of the metal members is somewhat noisy and introduces a shock to the system. It would therefore be desirable to have a leg press machine that provides a nonlinear increasing resistance curve, bio-mechanically correct movement, and a cushioned stop that absorbs shock and reduces the noise of the machine.

SUMMARY OF THE INVENTION

The present invention is a leg press machine that provides an increasing resistance curve which approximates the strength curve of a user. The machine has a weight stack that can move relative to a frame. The machine also has a push plate that is coupled to the weight stack by a cable that is guided and held in tension by a series of pulleys.

The push plate is attached to a first linkage arm which is pivotally connected to a second linkage arm and a third linkage arm. The second and third linkage arms are pivotally connected to the frame, so that the push plate can rotate between a rest position and an extended position. Attached to the third linkage arm is a first rotating pulley that moves through an arc when the push plate moves between the rest and extended positions. The cable is coupled to the first rotating pulley, so that when the push plate moves toward the extended position, the arcuate motion of the pulley pulls the cable and lifts the weight stack.

The linkage arms and pulley are assembled so that each successive displacement of the push plate and pulley, produces an incremental movement of the weight stack that is greater in length than the preceding incremental movement of the weight stack. When the user pushes the push plate forward at an essentially constant velocity, the increasing incremental movement of the weight stack provides a resistance curve that increases in a nonlinear manner. Such a nonlinear resistance curve more closely approximates the strength curve of the user than cable/pulley leg press machines found in the art.

The second and third linkage arms are constructed to provide an angular displacement of the push plate that closely approximates the angular movement of the user's feet, as the plate moves between the rest and extended positions.

The leg press machine also has a stop that limits the travel of the push plate to the rest and extended positions. The stop has soft contact surfaces to reduce the noise of the system and dampen the impact of the linkage arms on the frame. The stop is adjustable so that the user can vary the rest position of the push plate. The adjustable stop allows the user to create a certain amount of cable slack in the system. The frame also has an adjustable seat to vary the starting position and accommodate user's of different sizes.

Therefore it is an object of the present invention to provide a leg press that has a force resistance curve that approximates the strength curve of the user.

It is also an object of the present invention to provide a compact leg press with a resistance curve that approximates the strength curve of the user.

It is also an object of the present invention to provide a leg press which has a nonlinear resistance curve and provides a push plate movement that is bio-mechanically correct.

It is also an object of the present invention to provide a leg press that has a single stop which limits the movement of the push plate in both the rest and extended positions, and reduces the noise level of the system.

BRIEF DESCRIPTION OF THE DRAWINGS

The objects and advantages of the present invention will become more readily apparent to those skilled in the art after reviewing the following detailed description and accompanying drawings, wherein.

DETAILED DESCRIPTION OF THE DRAWINGS

Figure 1:
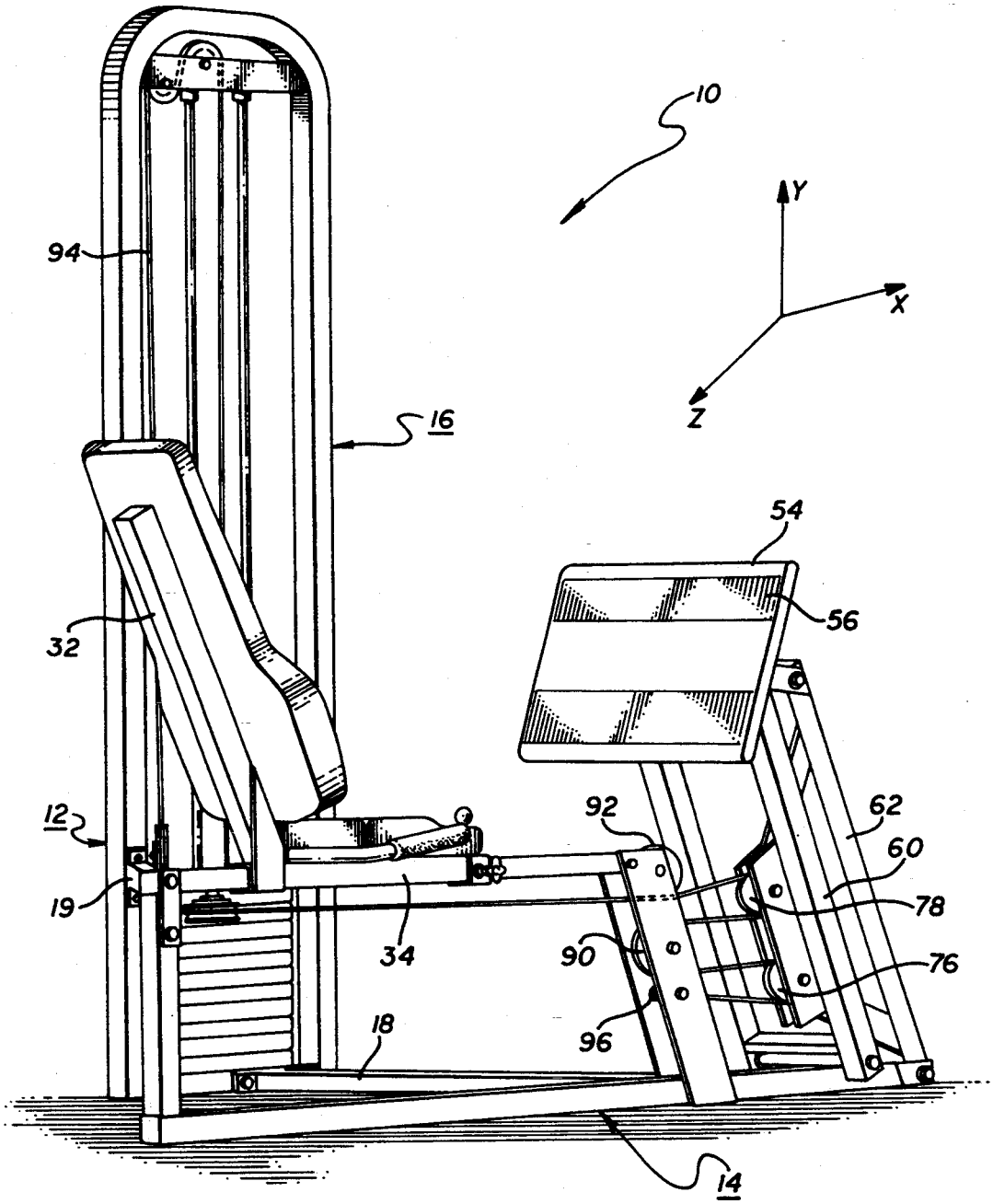
FIG. 1 is a perspective of a leg press of the present invention.

Referring to the drawings more particularly by reference numbers, FIG. 1 shows a leg press exercise machine 10 of the present invention. The leg press 10 is used primarily to strengthen the user's leg muscles, although other exercise routines could be employed with the present invention. The press 10 has a frame 12 that is typically constructed from metal tubes and plates. The metal is preferably steel which provides a frame 12 that is both rugged and strong. The frame 12 comprises a seat subassembly 14 coupled to a weight subassembly 16 by brace bars 18 and 19. The weight 16 and seat 14 subassemblies are preferably connected in a triangular configuration which provides a compact arrangement that can be operated using a minimal amount of space. Generally speaking it is desirable to provide a leg press that does not require a large amount of floor space. Minimizing the floor space of the leg press allows usage of the machine in small structures such as a user's home.

Figure 2:
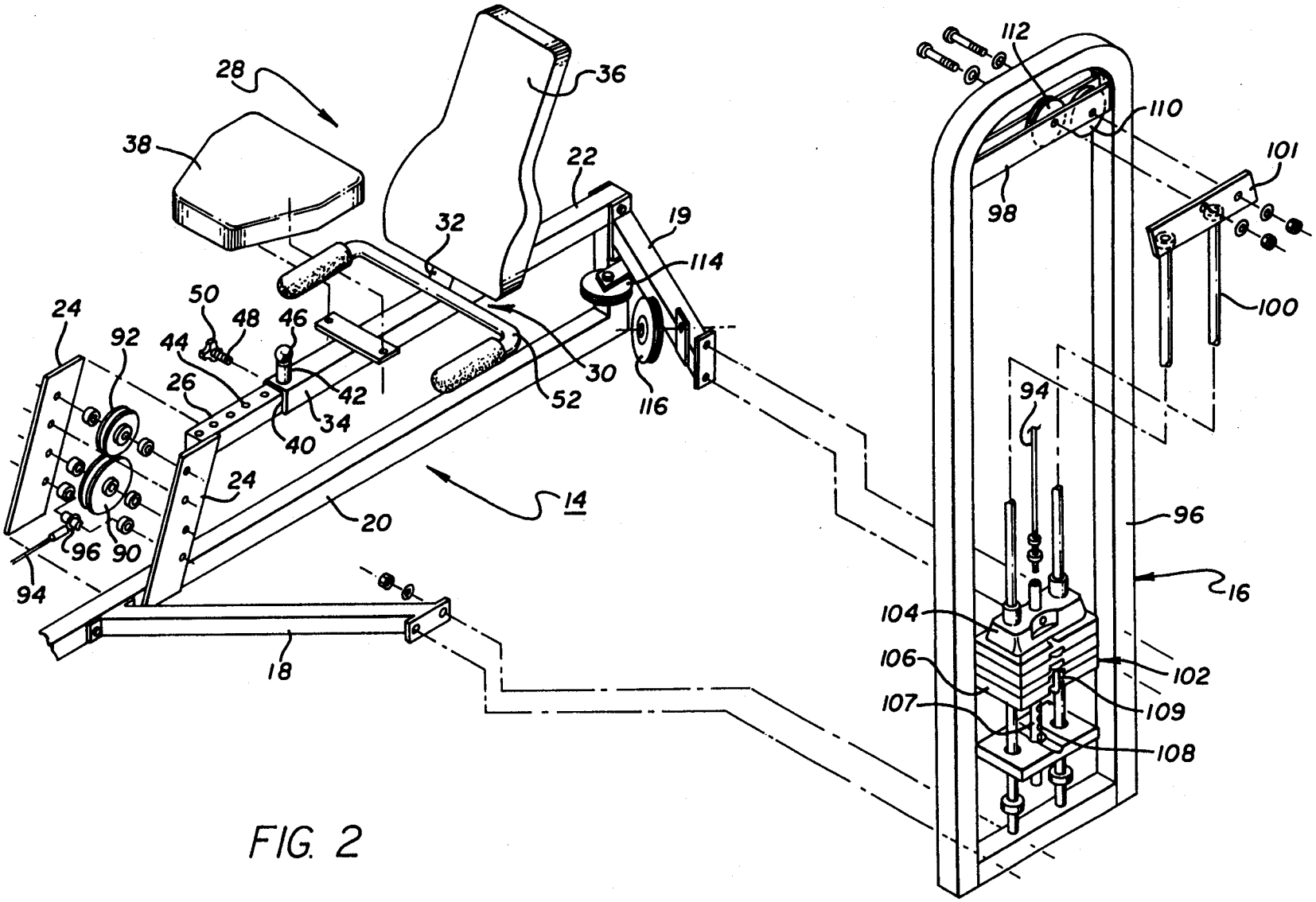
FIG. 2 is an exploded view of the seat and weight subassemblies of the leg press of FIG. 1.

As shown in FIG. 2, the seat subassembly 14 has a base member 20 that is rigidly connected to the brace bars 18 and 19. Attached to base member 20 is a first seat support bar 22 and a pair of second seat support brackets 24. The second support brackets 24 are typically oriented at an oblique angle relative to the base member 20. Attached to the first support bar 22 and second support brackets 24 is a third seat support bar 26 which typically extends essentially parallel with the base member 20.

A seat 28 is coupled to the third support bar 26. The seat 28 includes a seat frame 30 which has an upper portion 32 and a lower portion 34, see FIG. 1. The upper portion 32 supports an upper cushion 36. The lower portion 34 supports a lower cushion 38. The upper and lower cushions are typically constructed with a soft padding to provide user comfort. The lower frame portion 34 has a channel 40 that allows the seat 28 to slide along the third seat support bar 26. The seat 28 may have a captured spring loaded pin 42 that can be inserted into one of a plurality of holes 44 in the third support 26. The pin 42 has a handle 46 that allows the user to pull the pin 42 out of the hole 44, move the seat 28 to another location along the third bar 26, and then release the handle 46 so that the pin 42 is reinserted into a new hole 44. The pin/hole arrangement allows the user to adjust the seat 28 to a variety of locations along the third bar 26. The seat 28 may have a lock screw 48 that extends through the lower frame portion 34 and can engage the third support bar 26, to further secure the seat 28 to the seat subassembly 14. The lock screw 48 can be released and tightened by rotating the lock screw handle 50. The seat 28 may also have a pair of seat handles 52 that can be gripped by the user while operating the machine 10.

Figure 3:
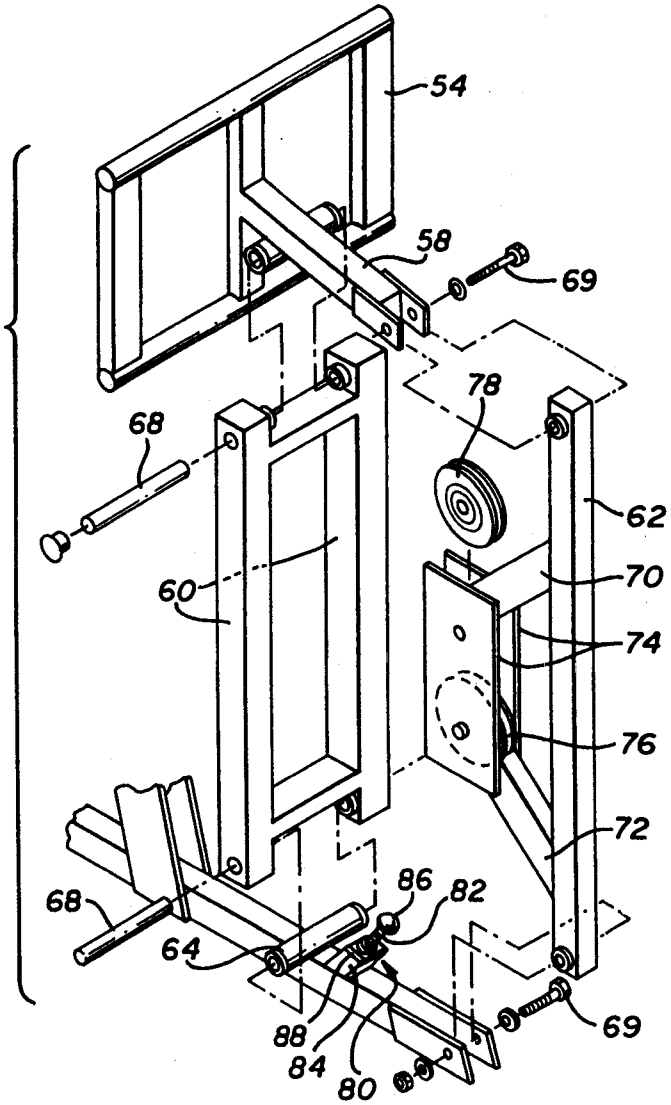
FIG. 3 is an exploded view of the push plate linkage assembly of the leg press of FIG. 1.

As shown in FIG. 3, the machine 10 has a push plate 54 with an area large enough to support both feet of the user. The front surface 56 of the push plate 54 (see FIG. 1) may be textured or have a pad to increase the friction between the plate and the user's feet. The plate 54 is rigidly attached to a first linkage arm 58. The first linkage arm 58 is pivotally connected to a pair of second linkage arms 60 and a third linkage arm 62. The second linkage arms 60 are spaced apart and pivotally connected to a second spacer bar 64 that is rigidly attached to the base member 20. The third linkage arm 62 is pivotally connected to the base member 20. The pivotal connections are typically performed by pins 68 or bolts 69 that extend through the linkage arms and allow relative movement of the members.

Connected to the third linkage arm 62 is a first pulley support arm 70 and a second pulley support arm 72. The pulley support arms are connected to a pair of first pulley brackets 74. The pulley brackets 74 support a first rotating pulley 76 and a second rotating pulley 78. The pulleys are assembled to freely rotate relative to the pulley brackets 74. The pivotal connection of the linkage arms allows the push plate and pulleys to move relative to base member 20.

Rigidly attached to the base member 20 is a stop 80. The stop 80 limits the travel of the linkage arms and push plate. The stop 80 may have a screw 82 that can be rotated in and out of a stop housing 84. The screw 82 preferably has a soft contact surface 86 that engages the second pulley support arm 72 when the push plate 54 is in a rest position. The stop housing 84 preferably has a soft pad 88 that engages the second linkage arm 60 when the push plate 54 is in an extended position. The soft contact members 86 and 88 reduce the noise of the machine 10, as the push plate 54 is moved between the rest and extended positions. The rest position of the push plate 54 can be adjusted by rotating the stop screw 82 relative to the housing 84. Rotating the screw 82 varies the height of the screw 82 and the location at which the second support arm 72 engages the stop 80.

Figure 4:
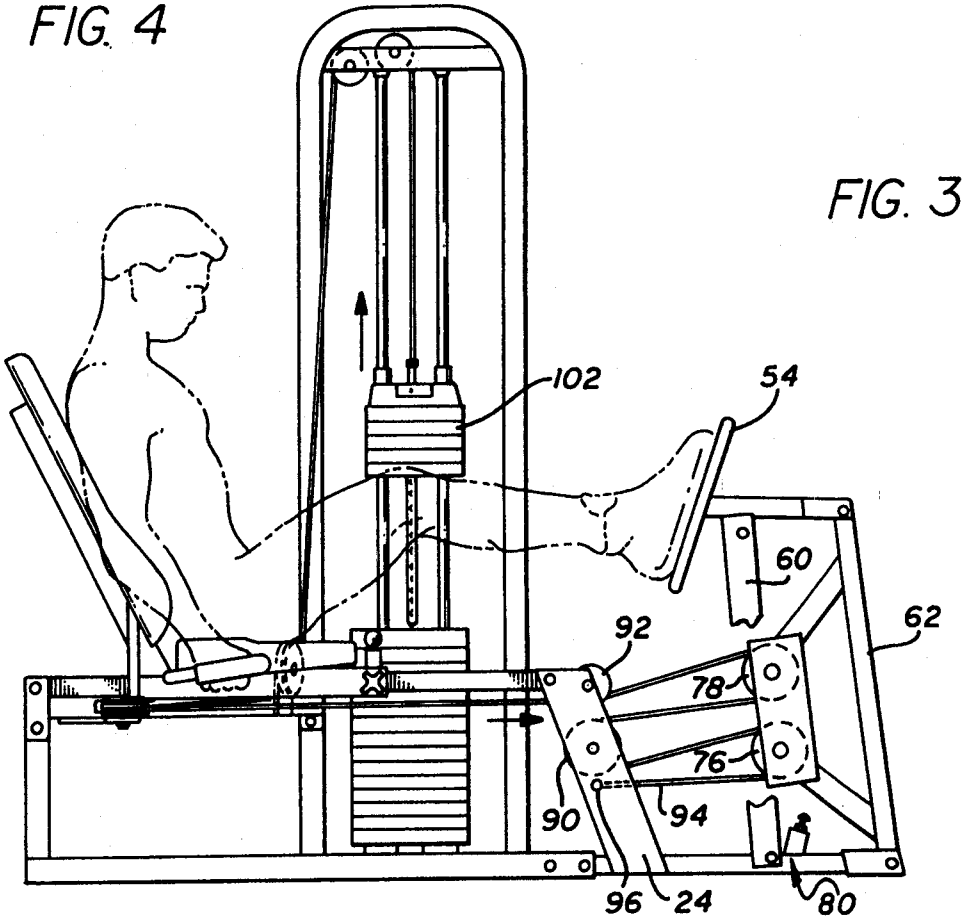
FIG. 4 is a side view of the leg press showing a user moving a push plate into a second position.

As shown in FIG. 2, a first fixed pulley 90 and a second fixed pulley 92 are attached to the second seat support brackets 24. The pulleys 90 and 92 are free to rotate relative to the brackets 24. As shown in FIG. 4, the pulleys 76-8 and 90-2, guide a cable 94 which has one end fixed to a pin 96 that is attached to the second support brackets 24. The cable 94 loops around the first rotating pulley 76, first fixed pulley 90 and second rotating pulley 78, and is then guided under the third support bar 26 by the second fixed pulley 92. The rotational freedom of the pulleys allows the cable to slide relative to the pulley members. The pulleys also insure that the cable is in tension. Although the second rotational pulley 78, first fixed pulley 90 and the second fixed pulley 92 are shown, it is to be understood that the present invention may be used with only the first rotational pulley 76. The second fixed pulley 92 primarily functions as a cable guide, while the pulleys 78 and 90 provide extra resistance and tension in the cable 94.

As shown in FIG. 2, the weight subassembly 16 has a weight frame 96 that is connected to the brace bars 18 and 19. The weight frame 96 may be constructed in a U shape to improve the safety and appearance of the assembly. Attached to the weight frame 96 are a pair of second pulley support brackets 98. A pair of guide rods 100 are connected to the support brackets 98 by a guide rod bracket 101. The guide rods 100 guide a weight stack 102 located between the weight frame 96. The weight stack 102 is comprised of a lift plate 104 and a plurality of individual weights 106. The lift plate 104 has a rod 107 with a number of holes 108 that can receive a pin 109 which extends under any individual weight 106. The pin 109 and lift plate 104 couple a number of weights 106 together to define the amount of weight to be lifted by the user. The pin 109 can be detached and reinserted at different locations, allowing the user to vary the amount of weight lifted.

The cable 94 is attached to the rod 107 which is secured to the lift plate 104. The cable 94 is guided to the lift plate 104 by a first weight pulley 110 and a second weight pulley 112. The pulleys 110 and 112 are connected to the second pulley support brackets 98 and are constructed to rotate relative to the weight frame 96. Although two weight pulleys are shown, it is to be understood that one pulley with a sufficient radius can be employed. The cable 94 is further guided from the seat subassembly 14 to the weight subassembly 16 by a first coupling pulley 114 and a second coupling pulley 116. The first and second coupling pulleys are connected to a guide bar 118 that is attached to the weight frame 96 and third support bar 26. The cable 94 is guided from the seat subassembly 14 to the weight subassembly 16 by the coupling pulleys 114 and 116. The pulleys and cable mechanically couple the linkage arms and push plate 54 with the weight stack 102.

As shown in FIG. 4, when a user pushes the push plate 54 from the rest position toward the extended position, the movement of the plate 54 rotates the linkage arms 60 and 62, and the rotating pulleys 76 and 78. Moving the rotating pulleys 76 and 78 away from the fixed pulleys 90 and 92, moves the cable 94 in the direction indicated by the arrow. The cable movement is translated through the coupling and weight pulleys to the weight stack 102. The cable transmits the force exerted by the user, which lifts the weight stack 102 in a vertical direction.

Figure 5:
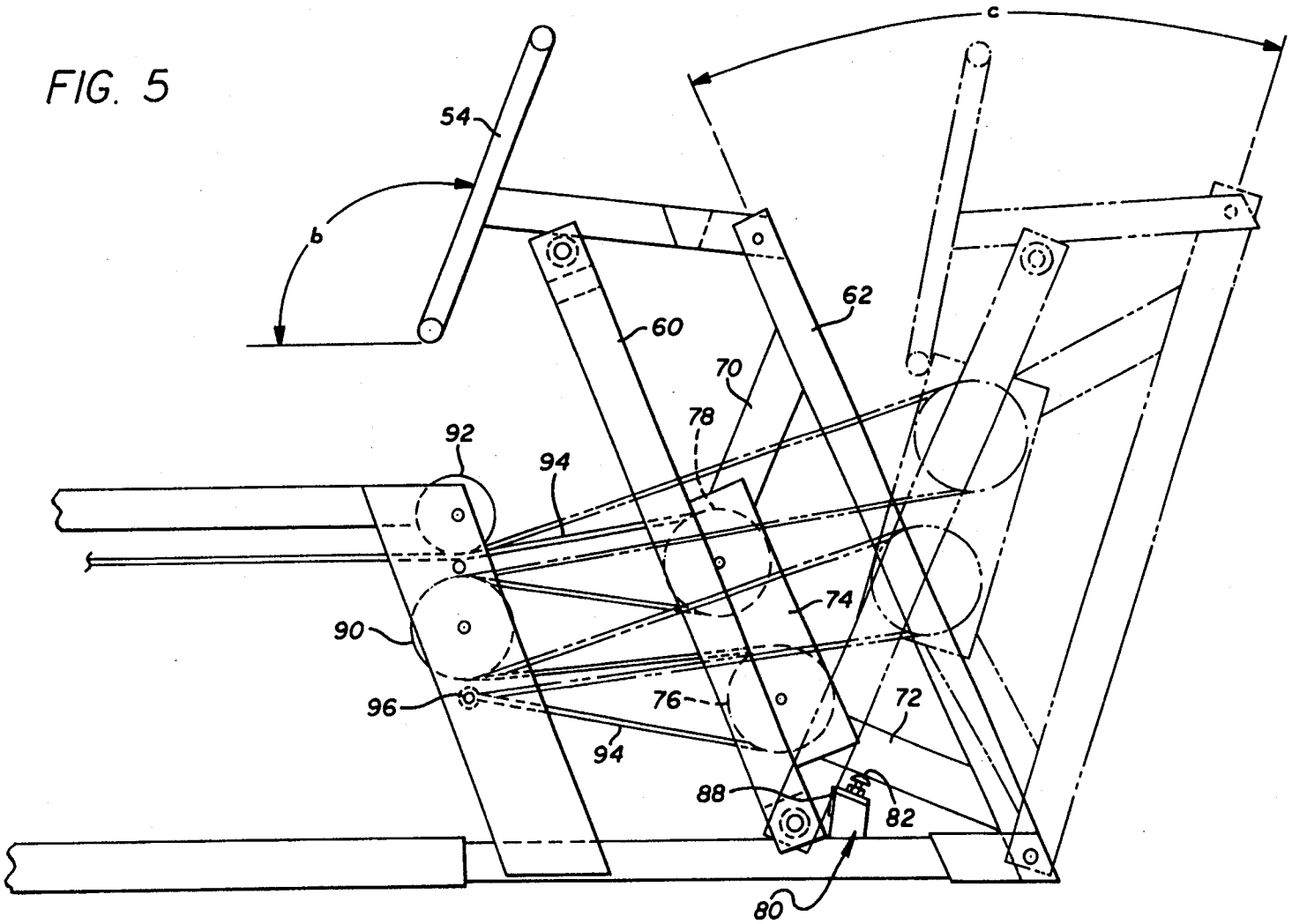
FIG. 5 is an enlarged view of the linkage/pulley assembly of the leg press, showing the push plate in first and second positions.

As shown in FIG. 5, the user can push the plate 54 until the second linkage arm 60 engages the stop 80. The plate 54 can be maintained in the extended position by exerting a force approximating the weight of the weight stack 102. When the user reduces the force on the plate 54, the weight of the weight stack 102 moves the same in a downward direction. The weight stack movement is translated through the cable 94 to the pulleys 76 and 78, which pull the linkage arms and push plate 54 back toward the rest position. The push plate 54 can continue to move until the second pulley support arm 72 engages the stop 80. The pulleys typically keep the cable 94 in tension throughout the exercise routine. As an alternate mode of operation, the screw 82 can be adjusted so that there is no tension in the cable 94 when the push plate 54 is in the rest position. This allows the user to perform an exercise routine that has no resistive force during an initial movement of the push plate 54.

Figure 6:
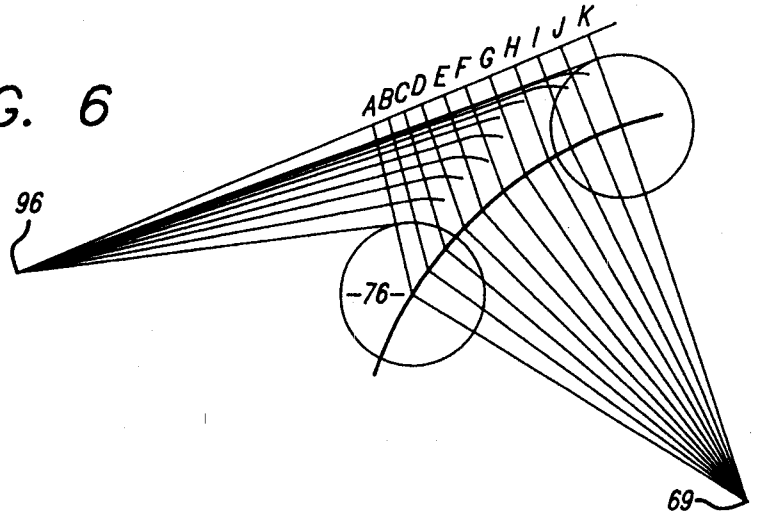
FIG. 6 is a schematic showing the movement of a first rotating pulley.

FIG. 6 shows the movement of the first rotating pulley relative to pin 69 of the third linkage arm 62, as the push plate 54 is moved from the rest position to the extended position. Points A-K show the position of the cable 94 at the top of the pulley 76 relative to the bottom of the pulley 90. Table I shows the increase in cable length as the pulley and push plate are pushed into the extended position. L is the change in cable length between the points A and B. The arc between each point (A-B, B-C, etc.) is the same for each angular segment. Each change in cable length causes a corresponding displacement of the weight stack 102.

TABLE I

| POINTS | ANGULAR PULLEY DISPLACEMENT | INCREASE IN CABLE LENGTHS |
|---|---|---|
| A-B | 4° | L |
| B-C | 4° | 1.16 × L |
| C-D | 4° | 1.32 × L |
| D-E | 4° | 1.44 × L |
| E-F | 4° | 1.56 × L |
| F-G | 4° | 1.68 × L |
| G-H | 4° | 1.76 × L |
| H-I | 4° | 1.80 × L |
| I-J | 4° | 1.82 × L |
| J-K | 4° | 1.82 × L |

As shown in Table I, the change in cable length between each point increases as the pulley 76 incrementally moves from the rest position to the extended position. This increasing cable length has been found to occur when the relationship between the pins 69 and 96, and pulley 76 are such that the pulley 76 moves along an arc upward and outward from pin 96.

Figure 7:
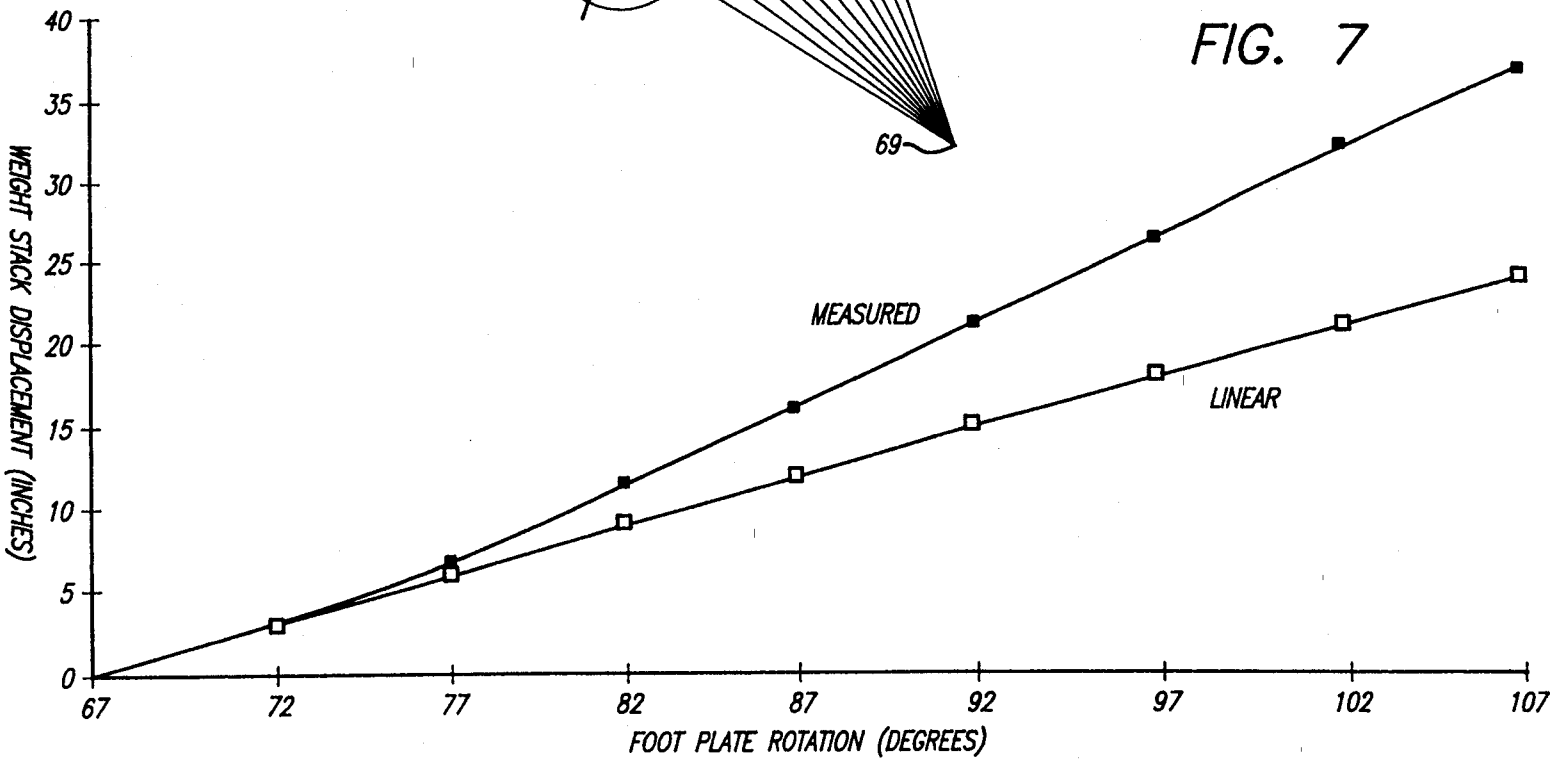
FIG. 7 is a graph showing the movement of the weight stack versus the rotation of the push plate.

FIG. 7 shows a graph of the pulley movement versus the displacement of the weight stack. It can be seen from the graph that the incremental displacement of the weight stack increases in a nonlinear manner as the push plate moves from the rest position to the extended position. For example, the incremental weight stack displacement when the pulley rotates from 72°–77° is approximately 4 inches. The incremental weight stack displacement between the angles 97°–102° is approximately 6 inches. The incremental weight stack movement increases, because as shown in Table I, the increment movement of the pulley increases as the pulley moves toward the extended position. If the user moves the push plate with an essentially constant velocity, the resistive force of the weigh stack increases in a nonlinear manner, because the acceleration (v.dl/dt) of the weight stack increases as the push plate moves towards the extended position. Because the user's leg strength increases as his legs straighten (which occurs as the push plate is being pushed into the extended position), the resulting feel to the user is a constant resistive force by the weight stack. The present invention thereby provides a resistive force curve that approximates the strength curve of the user.

As shown in FIG. 5, the third linkage arm 62 moves through an angle c when the plate is pushed from the rest position to the extended position. In the preferred embodiment the plate moves approximately 15 inches through an angle of approximately 40°. The push plate 54 is initially at an angle b relative to an axis parallel to the base member 20. In the preferred embodiment this angle is approximately 112°. It has been found that such angles provide optimum user comfort and approximate a correct bio-mechanical positioning of the feet and legs of the user. Adjustments may be made by the user by moving the feet relative to the front surface 56 of the plate and/or adjusting the seat 28. The linkage arms 60 and 62 are of such length and spacing that the angle D gradually decreases when the push plate 54 moves from the rest position to the extended position. In the preferred embodiment, the angle decreases to 101° when the push plate is rotated 40°. It has been found that this decrease in the plate angle approximates the angular relationship of the user's feet and legs, as the user pushes the plate forward. Utilizing a correct bio-mechanical movement of the plate reduces the stress on the ankles and feet of the user. In the preferred embodiment the linkage arms 58–62 and base member 20 are arranged as a trapezoid with the second linkage arm 60 being constructed shorter than the third linkage arm 62. This insures a decreasing angle as the push plate is moving toward the extended position. The present invention also insures that the first pulley 76 is always traveling in an upward direction (increasing incremental movement) even when the third linkage arm 62 is moving in a downward direction. Thus the leg press generates an increasing resistance curve while providing a push plate that is bio-mechanically in synchronization with the user.

While certain exemplary embodiments have been described in detail and shown in the accompanying drawings, it is to be understood that such embodiments are merely illustrative of and not restrictive on the broad invention and that this invention not be limited to the specific constructions and arrangements shown and described, since various other modifications may occur to those ordinarily skilled in the art.

What is claimed is:

1. An exercising apparatus, comprising:

a frame;

a weight adapted to move relative to said frame;

a cable coupled to said weight;

a push member operatively connected to said frame, said push member being adapted to move between a rest position and an extended position;

a linkage bar mechanism operatively connected to said frame, said push member and said weight such that said weight moves when said push member moves between said rest position and said extended position;

a first cable guide connected to said linkage bar mechanism for guiding said cable, said first cable guide being adapted to be moved through an arc by said linkage bar mechanism, so that when said push member moves from the rest position to the said extended position said first cable guide moves along the arc in a manner where each successive incremental movement of said first cable guide is greater than a preceding incremental movement of said first cable guide, wherein each successive incremental movement of said push member produces an incremental movement of said weight that is greater in length than a preceding incremental movement of said weight;

wherein said linkage bar mechanism includes a first linkage arm connected to said push member, a second linkage arm pivotally connected to said frame and said first linkage arm, a third linkage arm pivotally connected to said frame and said first linkage arm, said pulley assembly also including a first pulley support arm connected to said third linkage arm and said first cable guide, wherein said frame and said first, second, and third linkage arms are arranged as a trapezoid, and said second linkage arm is shorter than said third linkage arm.

2. An exercise apparatus, comprising:

a frame;

a weight adapted to move relative to said frame;

a push member operatively connected to said frame, said push member being adapted to move between a rest position and an extended position;

a first linkage arm connected to said push member;

a second linkage arm pivotally connected to said frame and said first linkage arm;

a third linkage arm pivotally connected to said frame and said first linkage arm;

a first pulley support arm connected to said third linkage arm;

a first rotating pulley connected to said first pulley support arm such that said first rotating pulley moves through an arc in a manner where each successive incremental movement of said first rotating pulley is greater than a preceding incremental movement of said first rotating pulley when said push member moves from the rest position to the extended position;

a cable operatively connected to said frame, said first rotating pulley and said weight such that said weight moves when said push member moves between said rest and extended positions;

wherein said frame and said first, second, and third linkage arms are arranged as a trapezoid, and said second linkage arm is shorter than said third linkage arm.

3. The apparatus as recited in claim 2, further comprising a stop adapted to engage said second linkage arm and prevent movement of said push member beyond said extended position.

4. The apparatus as recited in claim 3, further comprising a second pulley support arm connected to said third linkage arm, said stop being adapted to engage said second pulley support arm and prevent movement of said push member beyond said rest position.

5. The apparatus as recited in claim 4, wherein said stop includes a screw that can be screwed in and out of a stop housing, said screw being adapted to engage said second pulley support arm and prevent movement of said push member, wherein rotation of said screw varies said rest position of said push member.

6. An exercise apparatus, comprising:

a frame that has a seat subassembly and a weight subassembly;

a weight stack operatively connected to said weight subassembly, said weight stack being adapted to move from a rest position;

a push plate operatively connected to said seat subassembly, said push plate being adapted to move between a rest position and an extended position;

stop means connected to said frame for preventing movement of said push plate beyond said rest and extended positions;

a first linkage arm connected to said push plate;

a second linkage arm pivotally connected to said frame and said first linkage arm;

a third linkage arm pivotally connected to said frame and said first linkage arm, said third linkage arm being spaced further from said push plate than said second linkage arm;

a first pulley support arm connected to said third linkage arm;

a second pulley support arm connected to said third linkage arm;

a first rotating pulley connected to said first and second pulley support arms such that said first rotating pulley moves through an arc in a manner where each successive incremental movement of said first rotating pulley is greater than a preceding incremental movement of said first rotating pulley when said push member moves from the rest position to the extended position;

a first fixed pulley attached to said seat subassembly;

a cable operatively connected to said frame, said first rotating pulley, said first fixed pulley and said weight stack such that said weight stack moves when said push plate moves between said rest and, extended positions;

wherein said frame and said first, second and third linkage arms are arranged as a trapezoid, and said third linkage arm is longer than said second linkage arm.

7. The apparatus as recited in claim 6, wherein said stop means includes a screw than can be screwed in and out of a stop housing, said screw being adapted to engage said second pulley support arm and prevent movement of said push plate beyond said rest position, wherein rotation of said screw varies said rest position of said push plate.

8. The apparatus as recited in claim 7, wherein said screw has an elastic contact surface that engages said second pulley support arm.

9. The apparatus as recited in claim 8, wherein said stop housing has an elastic pad that engages said second linkage arm.

10. The apparatus as recited in claim 8, further comprising a second rotating pulley attached to said first and second pulley support arms and a second static pulley attached to said seat subassembly.

11. The apparatus as recited in claim 7, wherein said seat subassembly has an adjustable seat.

* * * * *

UNITED STATES PATENT AND TRADEMARK OFFICE
CERTIFICATE OF CORRECTION

PATENT NO. : 5,366,432

DATED : November 22, 1994

INVENTOR(S) : Habing

It is certified that error appears in the above-identified patent and that said Letters Patent is hereby corrected as shown below:

column 1, line 47, after "coupled to the push"
change "place" to -- plate -- column 9, line 9, after "between said rest"
change "and," to -- and --

Signed and Sealed this

Twenty-eight Day of March, 1995

*Attest:*

*Attesting Officer*

Bruce Lehman

BRUCE LEHMAN

*Commissioner of Patents and Trademarks*